US010695782B2

(12) United States Patent
Boulais

(10) Patent No.: US 10,695,782 B2
(45) Date of Patent: Jun. 30, 2020

(54) FLUID DISPENSING DEVICE, AND VALVE HAVING A RETURN MEANS

(71) Applicant: GB DEVELOPPEMENT, Puteaux (FR)

(72) Inventor: Guillaume Boulais, Levallois Perret (FR)

(73) Assignee: GB DEVELOPMENT, Vernon (FR)

( * ) Notice: Subject to any disclaimer, the term of this patent is extended or adjusted under 35 U.S.C. 154(b) by 0 days.

(21) Appl. No.: 15/302,332

(22) PCT Filed: Apr. 9, 2015

(86) PCT No.: PCT/EP2015/057789

§ 371 (c)(1),
(2) Date: Oct. 6, 2016

(87) PCT Pub. No.: WO2015/155318

PCT Pub. Date: Oct. 15, 2015

(65) Prior Publication Data

US 2017/0021375 A1 Jan. 26, 2017

(30) Foreign Application Priority Data

Apr. 10, 2014 (FR) ..... 14 53181

(51) Int. Cl.
*B05B 11/00* (2006.01)

(52) U.S. Cl.
CPC ..... *B05B 11/3032* (2013.01); *B05B 11/007* (2013.01); *B05B 11/0062* (2013.01); *B05B 11/3064* (2013.01)

(58) Field of Classification Search
CPC ..... B05B 11/3032; B05B 11/0062; B05B 11/007; B05B 11/3064; B05B 11/3033; B05B 11/303

(Continued)

(56) References Cited

U.S. PATENT DOCUMENTS 1,296,884 A * 3/1919 Volk ..... B65D 47/2031 222/494
2,755,974 A * 7/1956 Godfrey ..... B65D 47/2037 222/494

(Continued)

FOREIGN PATENT DOCUMENTS

EP 0 442 858 A2 8/1991
EP 0 649 683 A1 4/1995

(Continued)

OTHER PUBLICATIONS

International Search Report for corresponding International Application No. PCT/EP2015/057789 dated Jul. 15, 2015.

*Primary Examiner* — Charles Cheyney
(74) *Attorney, Agent, or Firm* — Renner, Otto, Boisselle & Sklar, LLP

(57) ABSTRACT

The invention relates to a device for dispensing a fluid including: a tank arranged so as to contain the fluid; a dispensing pipe arranged so as to guide the fluid in a dispensing direction; a dispensing opening connecting the tank to the dispensing pipe; a dispensing valve which, in an open state, allows fluid to pass from the inside of the tank to the dispensing pipe via the dispensing opening and, in a closed state, does not allow fluid to pass from the inside of the tank to the dispensing pipe; and a return means arranged so as to exert a force on the dispensing valve. Said force moves the dispensing valve from the open state thereof to the closed state thereof. The return means includes a pouch forming a cavity. Said pouch is located in the dispensing pipe. The shape of the pouch is changed via compression when the dispensing valve is in the open state.

20 Claims, 4 Drawing Sheets

Figure 1:
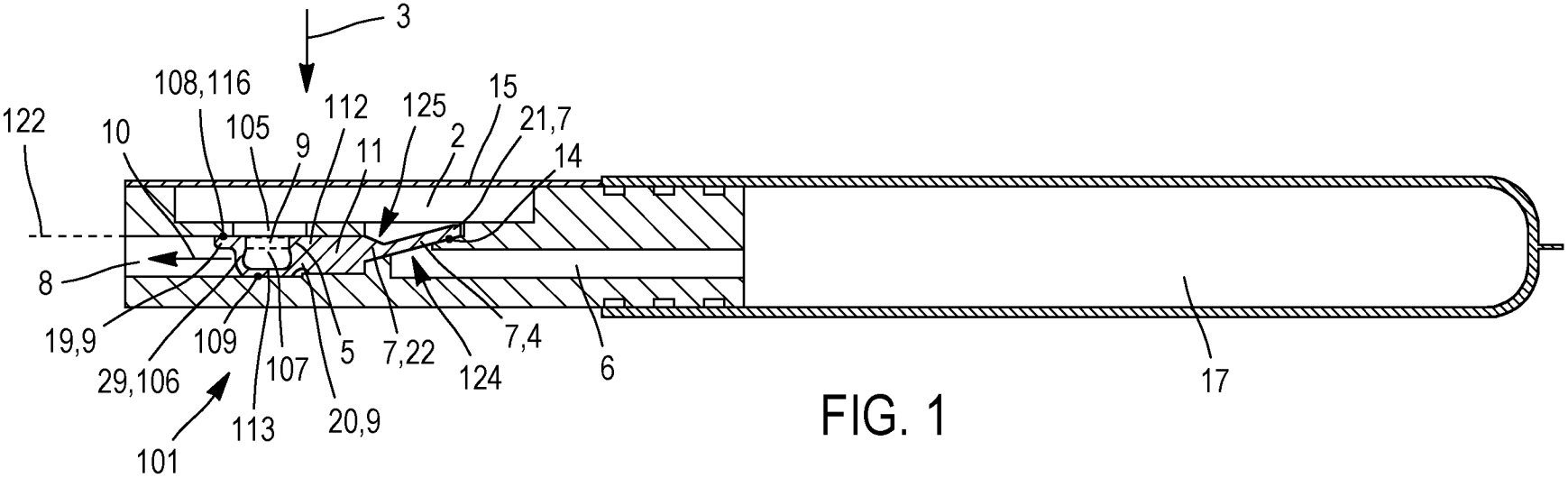

(58) Field of Classification Search
USPC ..... 222/207–215, 380, 494
See application file for complete search history.

(56) References Cited

U.S. PATENT DOCUMENTS 2,993,654 A * 7/1961 Norton ..... F16K 7/07 239/533.13
3,843,025 A * 10/1974 Holt ..... B05B 11/3032 222/207
3,895,747 A * 7/1975 Aoki ..... B29C 45/234 137/843
3,995,774 A * 12/1976 Cooprider ..... B05B 11/303 222/207
4,069,951 A * 1/1978 von Winckelmann ..... B65D 47/2031 222/494
4,138,038 A * 2/1979 Grogan ..... B05B 11/3033 222/207
4,179,051 A * 12/1979 Thomas ..... A61M 3/0262 137/454.2
4,489,750 A * 12/1984 Nehring ..... A61C 17/028 137/496
4,597,511 A * 7/1986 Licari ..... B05B 11/3067 137/454.6
4,653,539 A * 3/1987 Bell ..... A61M 25/1018 128/207.15
4,874,117 A * 10/1989 Kay ..... A45D 34/042 220/326
4,890,773 A * 1/1990 Corsette ..... B05B 11/0048 222/256
4,921,017 A * 5/1990 Tada ..... B05B 11/0064 137/843
5,020,562 A * 6/1991 Richmond ..... A61M 39/02 137/15.01
5,190,190 A * 3/1993 Fudalla ..... B05B 11/047 137/512.4
5,505,341 A 4/1996 Gueret
5,769,585 A * 6/1998 Podolsky ..... A46B 11/002 222/207
6,536,631 B1 * 3/2003 Nickels ..... B65D 47/2018 222/212
6,863,083 B2 * 3/2005 Danby ..... A45F 3/18 137/384
8,365,962 B2 * 2/2013 Canfield ..... B05B 11/0016 222/153.13
9,004,317 B2 * 4/2015 Pozzi ..... B65D 35/38 222/189.09
9,085,409 B2 * 7/2015 Brall ..... B65D 35/46
2005/0230425 A1 * 10/2005 Genosar ..... B05B 11/0037 222/207
2005/0260090 A1 * 11/2005 Stark ..... B05B 11/0021 417/559
2006/0065677 A1 3/2006 Py et al.
2009/0173751 A1 * 7/2009 Laidler ..... B05B 11/303 222/207
2013/0336823 A1 * 12/2013 Ophardt ..... F04B 7/00 417/447

FOREIGN PATENT DOCUMENTS

FR 2 962 986 A1 1/2012
WO WO 03/097250 A1 11/2003
WO WO 2010/131042 A1 11/2010

* cited by examiner

FLUID DISPENSING DEVICE, AND VALVE HAVING A RETURN MEANS

TECHNICAL FIELD

The present invention relates to a device for dispensing a fluid comprising a valve provided with a return means.

The technical field of the invention is non-limitatively that of devices for dispensing soap, cosmetics, or other substances, for smaller or larger volumes to be dispensed, for example, a device fixed to a wall for dispensing large volumes of soap or also a device of the promotional sample type for smaller volumes of cosmetics.

STATE OF THE ART

Devices for dispensing a fluid are known, such as that described in document FR2 962 986 and comprising a valve.

Such a device can comprise a return means arranged so that the valve is subjected to a return force tending to bring the valve back into its closed state, these return means comprising a resilient tongue acting as a spring. With such a return means, the leak-tightness of the device is considerably improved.

However, the leak-tightness could be further improved.

The purpose of the present invention is to still further improve the leak-tightness of such a device.

DISCLOSURE OF THE INVENTION

Such an objective is achieved with a device for dispensing a fluid, comprising:

- a reservoir arranged in order to contain the fluid,
- a dispensing pipe arranged in order to guide the fluid in a dispensing direction,
- a dispensing orifice connecting the reservoir to the dispensing pipe,
- a dispensing valve which, in an open state, allows fluid to pass from the inside of the reservoir to the dispensing pipe via the dispensing orifice, and, in a closed state, does not allow fluid to pass from the inside of the reservoir to the dispensing pipe, and
- a return means arranged in order to exert a force on the dispensing valve, this force bringing the dispensing valve back from its open state to its closed state, characterized in that the return means comprises a pouch forming a cavity, said pouch being situated in the dispensing pipe, the pouch being deformed by compression when the dispensing valve is in the open state.

The pouch can be a pouch that is open on one side by an opening delimited by an outer edge of the cavity such that:

- in the closed state the outer edge of the cavity is pressed flat against a first inner wall of the dispensing pipe, and/or
- in the closed state, a bottom of the pouch rests against a second inner wall of the dispensing pipe, and in the open state of the dispensing valve, the outer edge of the cavity or the bottom of the pouch moves away (with respect to the closed state of the dispensing valve) respectively from the first or second inner wall of the dispensing pipe.

In the open state of the dispensing valve, the bottom of the pouch can move away (with respect to the closed state of the dispensing valve) from the second inner wall of the dispensing pipe, and the second inner wall can be provided with a convex boss and the bottom of the pouch can be provided with a concave recess of a shape complementary to the convex boss such that in the closed state, the concave recess fits the shape of the convex boss.

The first inner wall can comprise a periphery of the dispensing orifice such that:

- in the closed state the outer edge of the cavity is in contact with a part or all of the periphery of the dispensing orifice or surrounds a part or all of the periphery of the dispensing orifice,
- in the open state (and preferably also, but not necessarily, in the closed state), the bottom of the pouch rests against the second inner wall of the dispensing pipe, and
- in the open state of the dispensing valve, the outer edge of the cavity moves away (with respect to the closed state of the dispensing valve) from the dispensing orifice.

The second inner wall can comprise a periphery of the dispensing orifice such that:

- in the open state (and preferably also, but not necessarily, in the closed state), the outer edge of the cavity is in contact with the first inner wall,
- in the closed state, the bottom of the pouch rests against the dispensing orifice, and
- in the open state of the dispensing valve, the bottom of the pouch moves away (with respect to the closed state of the dispensing valve) from the dispensing orifice.

The bottom of the pouch and the remainder of the pouch can be made of two different materials, the bottom of the pouch being made of a stiffer material than the remainder of the pouch.

The pouch can form, in a plane, a closed loop inside which the cavity is delimited such that:

- in the closed state a first side of the loop is pressed flat against a first inner wall of the dispensing pipe,
- in the open state (and preferably also, but not necessarily, in the closed state), a second side of the loop rests against a second inner wall of the dispensing pipe, and
- in the open state of the dispensing valve, the first side of the loop moves away (with respect to the closed state of the dispensing valve) from the first inner wall of the dispensing pipe.

In this case, the first inner wall can comprise a periphery of the dispensing orifice such that:

- in the closed state the first side of the loop is pressed flat against the dispensing orifice without allowing fluid to pass between the reservoir and the dispensing pipe,
- in the open state of the dispensing valve, the first side of the loop moves away (with respect to the closed state of the dispensing valve) from the dispensing orifice in order to allow fluid to pass between the reservoir and the dispensing pipe.

When the dispensing valve is in the open state, the pouch is preferably deformed by a compression perpendicular to the dispensing direction.

The pouch can be firmly fixed to a stiffening element stiffer than the pouch and extending in the dispensing direction.

According to another aspect of the invention, a dispensing valve is proposed, comprising:

- a dispensing membrane which, in a closed state of the valve, is in a closing position, and in an open state of the valve is in an opening position, the opening position differing from the closing position by a bending of one free end of the membrane in a bending direction while another of its ends is held by a joining element, and a return means firmly fixed to the membrane and arranged in order to exert a force on the membrane, this force bringing the membrane back from its opening position to its closing position, characterized in that the return means comprises a pouch forming a cavity, said pouch being in contact with and firmly fixed to the membrane, the membrane and the pouch being aligned in the bending direction, the return means being arranged in order to exert the force on the membrane during a deformation of the pouch by a compression of the pouch in the bending direction when the dispensing valve is in the open state.

DESCRIPTION OF THE FIGURES AND EMBODIMENTS

Figure 12:
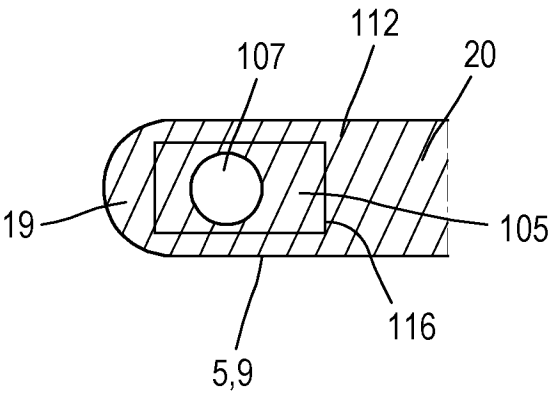
Figure 2:
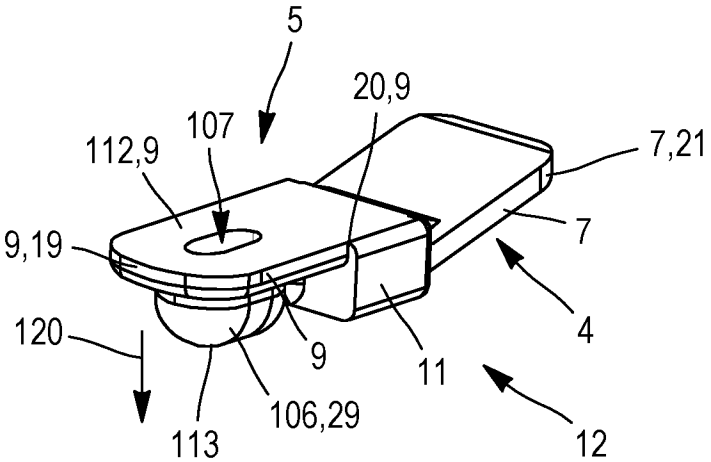
Figure 3:
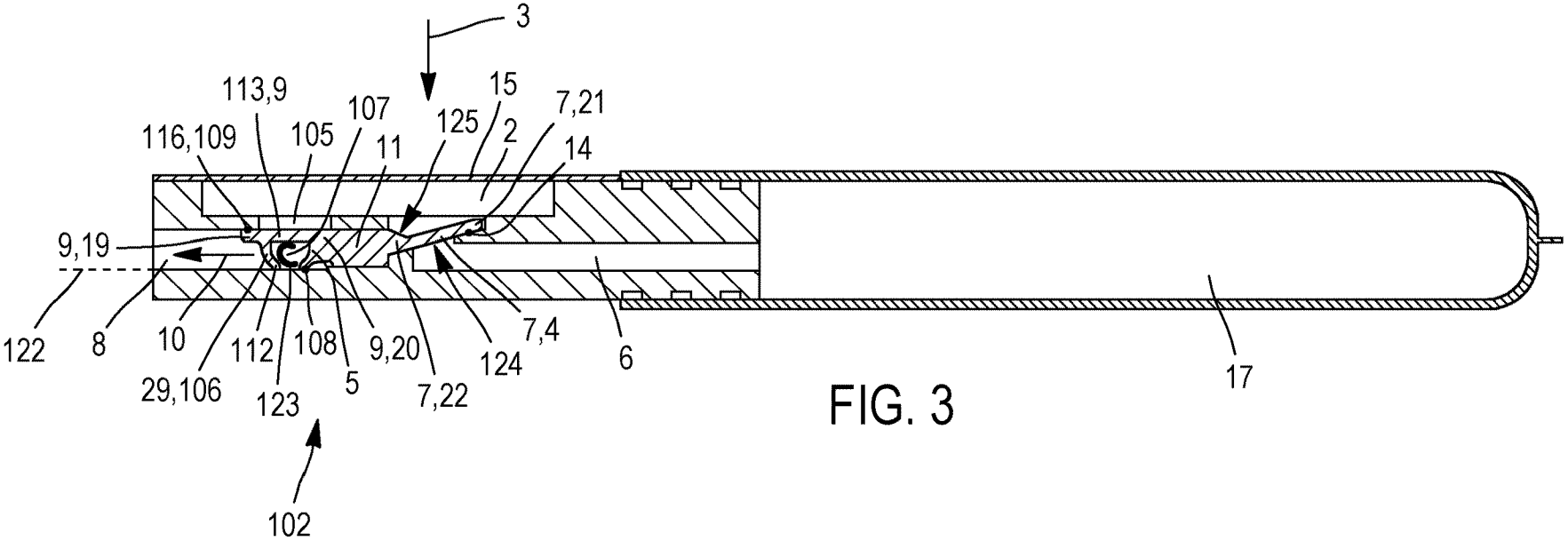
Figure 5:
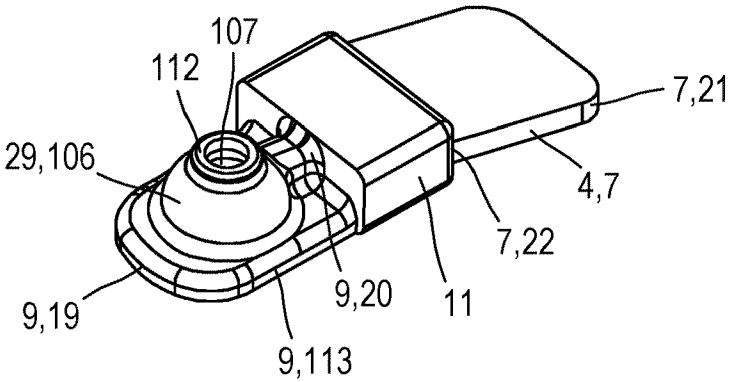
Figure 4:
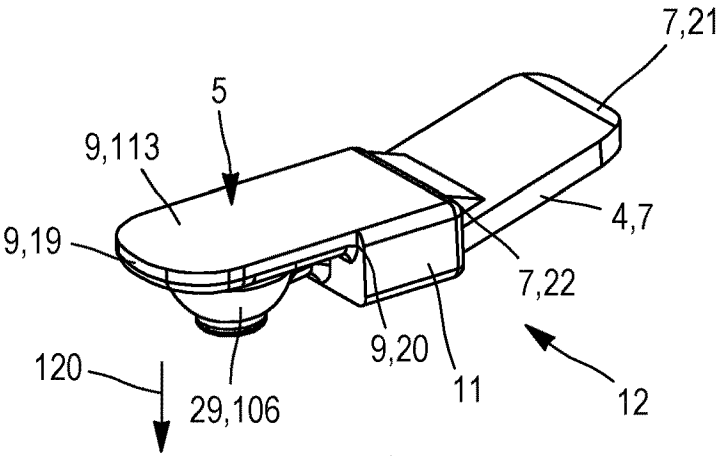
Figure 6:
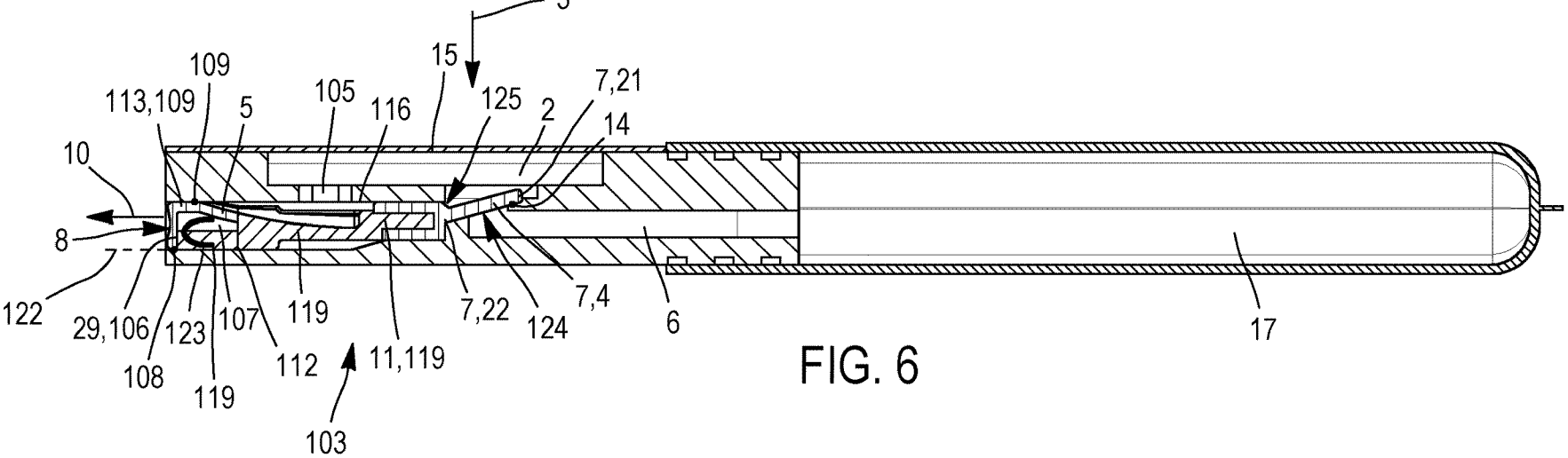
Figure 9:
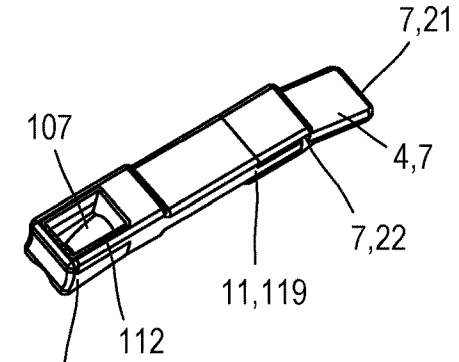
Figure 8:
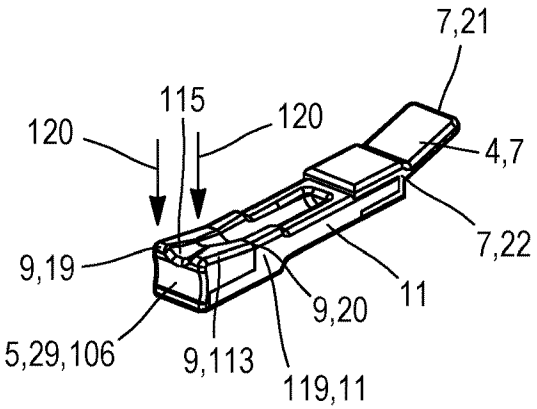
Figure 7:
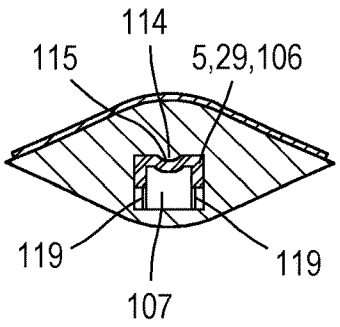
Figure 10:
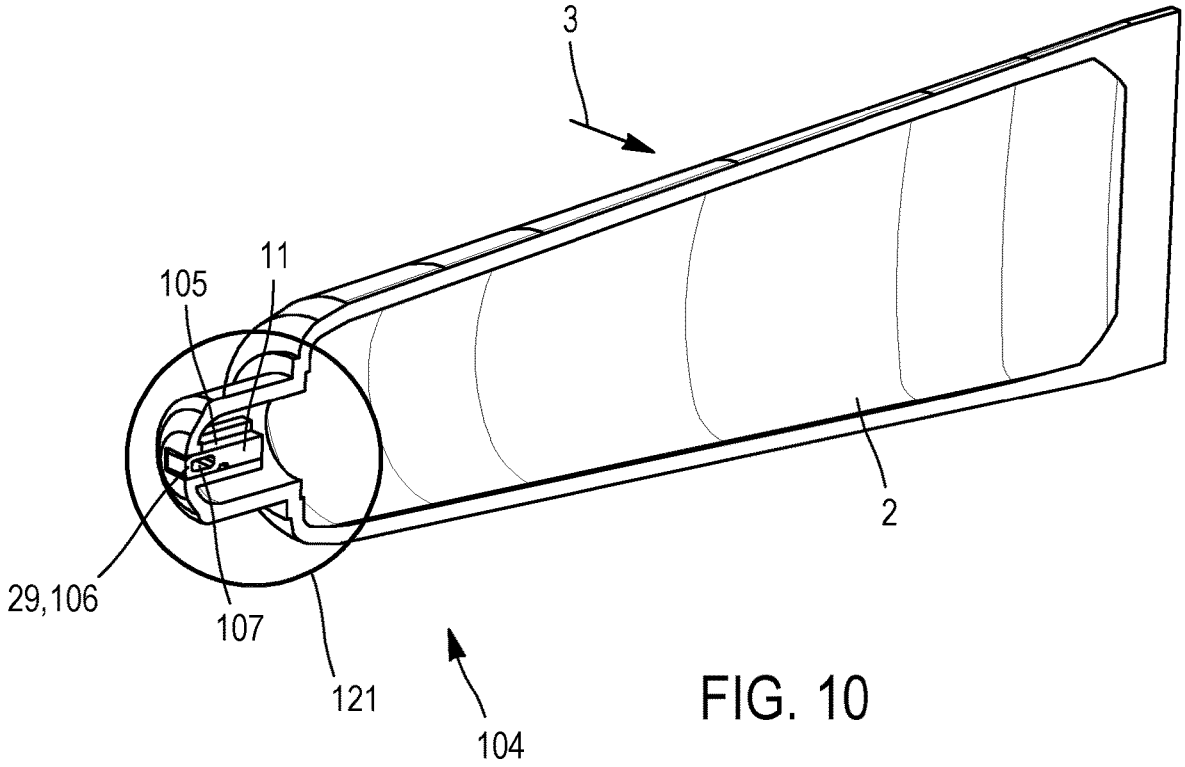
Figure 11:
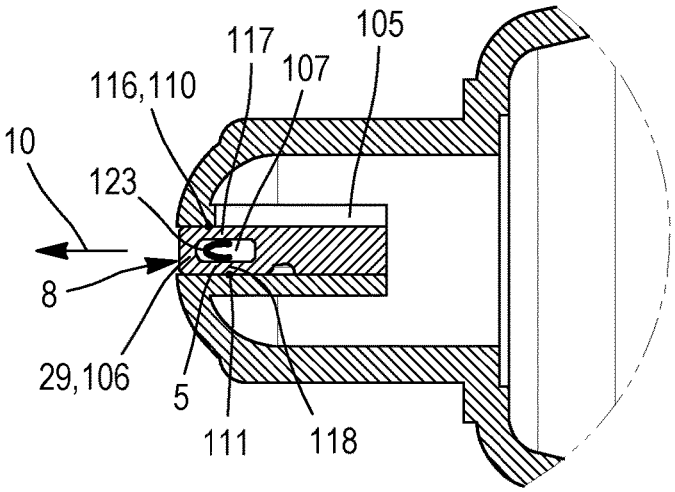

Other advantages and features of the invention will become apparent on reading the detailed description of implementations and embodiments that are in no way limitative, and the following attached drawings:

FIG. 1 is a profile cross-sectional view of a first embodiment of a device 101 according to the invention, FIG. 2 is a perspective view of the dispensing valve and of the feed valve of the first embodiment of the device according to FIG. 1, FIG. 3 is a profile cross-sectional view of a second embodiment of a device 102 according to the invention, FIGS. 4 and 5 are perspective views of the dispensing valve and of the feed valve of the second embodiment of the device according to FIG. 3, FIG. 6 is a profile cross-sectional view of a third embodiment of a device 103 according to the invention, FIG. 7 is a frontal cross-sectional view of the third embodiment of a device according to the invention, FIGS. 8 and 9 are perspective views of the dispensing valve and of the feed valve of the third embodiment of the device according to FIGS. 6 and 7, FIG. 10 is a perspective cross-sectional view of a fourth embodiment of a device 104 according to the invention, FIG. 11 is a profile cross-sectional view of a detail 121 of the fourth embodiment of the device of FIG. 10, and FIG. 12 is a top view of a part of the first embodiment of a device 101 according to the invention, showing a superimposition of the cavity 107 and of the dispensing orifice 105.

As these embodiments are in no way limitative, it is possible in particular to consider variants of the invention comprising only a selection of characteristics described below in isolation from the other characteristics described (even if this selection is isolated within a sentence comprising these other characteristics), if this selection of characteristics is sufficient to confer a technical advantage or to differentiate the invention with respect to the state of the art. This selection comprises at least one preferably functional characteristic without structural details, or with only a part of the structural details if this part alone is sufficient to confer a technical advantage or to differentiate the invention with respect to the state of the art.

A first embodiment of the device according to the invention 101 for dispensing fluid, and the dispensing valve 5 according to the invention which is associated with this device 101 will now be described with reference to FIGS. 1 to 2.

The device 101 for dispensing a fluid (liquid and/or gas), comprises a reservoir 2 arranged in order to contain the fluid. This fluid can consist either of a liquid or of a mixture of liquid and gas (for example a foam) or also of a gel. The fluid in the device 101 preferably comprises a liquid.

In FIG. 1, the reservoir 2 comprises a deformable reservoir, such as a flexible reservoir on which a pressure can be exerted manually in order to expel the fluid out of the device. Generally, this reservoir 2 could equally well be a tube or the pipe of a piston.

The device 101 comprises a dispensing pipe 8 (made in one piece from hard plastic) extending longitudinally in a dispensing direction 10 and arranged in order to guide the fluid in the dispensing direction 10.

The device 101 comprises a dispensing orifice 105 connecting the reservoir 2 to the dispensing pipe 8.

The device 101 comprises a dispensing valve 5 which comprises a dispensing membrane 9. The dispensing valve 5, in an open state, allows fluid to pass from the inside of the reservoir 2 to the dispensing pipe 8 via the dispensing orifice 105, and, in a closed state, does not allow fluid to pass from the inside of the reservoir 2 to the dispensing pipe 8 (by pressing the dispensing membrane 9 flat against the dispensing orifice 105 so as to block the dispensing orifice).

The dispensing valve 5 also comprises a joining element 11.

The dispensing membrane 9 comprises a free end 19 with respect to the joining element 11. This free end 19 is arranged in order to move so as to cause the dispensing valve 5 to pass between its open and closed states. The dispensing membrane 9 also comprises a joining part 20 firmly fixed to the joining element 11 and which does not move between the open and closed states of the dispensing valve 5.

The dispensing membrane 9 is:

in a closed state of the dispensing valve 5, in a closing position, and in an open state of the dispensing valve 5, in an opening position, the opening position differing from the closing position by a bending of the free end 19 of the membrane 9 in a bending direction 120 (perpendicular to the dispensing direction 10) while its other end 20 is held by the joining element 11.

The device 101 comprises a return means 29 arranged in order to exert a force on the dispensing valve 5 (more precisely on the dispensing membrane 9), this force bringing the dispensing valve 5 back from its open state to its closed state (more precisely bringing the dispensing membrane 9 back from its opening position to its closing position). In the case illustrated in FIG. 1, the return means 29 is in contact with and firmly fixed to the membrane 9. More precisely, in the case illustrated in FIG. 1, the return means forms part of the dispensing valve 5.

According to the invention, the return means 29 comprises a pouch 106 forming a cavity 107, said pouch 106 being situated in the dispensing pipe 8, the pouch 106 being deformed by compression against a wall 109 of the dispensing pipe when the dispensing valve 5 is in the open state.

The membrane 9 and the pouch 106 are aligned in the bending direction 120.

The return means 29 is arranged in order to exert the force on the membrane 9 during a deformation of the pouch 106 by a compression of the pouch 106 in the bending direction 120 when the dispensing valve 5 is in the open state.

Thus, the leak-tightness of the dispensing valve 5 is improved with respect to the state of the art. In fact, unlike a simple tongue which would create an inhomogeneous return force (stronger on the side of the free end 19 than of the joining part 20), the return means 29 in pouch 106, in the open state (and also preferably in the closed state) of the dispensing valve 5, bears on a broad zone of a wall 109 of the dispensing pipe (this broad zone being the zone of contact between the bottom 113 and the wall 109), which makes it possible to exert a more homogeneous return force than in the state of the art on the periphery 116 of the dispensing orifice 105.

Another significant advantage of the return means 29 in the form of pouch 106 is its stability during its insertion into the dispensing pipe 8. By contrast, a return means according to the state of the art in the form of a concave tongue risks turning over and becoming convex inside the dispensing pipe during the insertion of the dispensing valve into the dispensing pipe for its assembly.

The dispensing membrane 9 is situated between the dispensing orifice 105 and cavity 107 of the pouch 106.

The pouch 106 is a pouch that is open on one side only by an opening delimited by an outer edge 112 of the cavity 107. The cavity 107 is smaller in volume in the open state of the dispensing valve 5 than in the closed state of the dispensing valve 5. This volume is defined as being the volume of the cavity 107 inside the pouch 106 up to a plane 122 in which the outer edge 112 of the opening is situated.

The pouch 106 is a pouch open in a single plane by the opening delimited by the outer edge 112 (outer edge which is contained in this same plane).

The outer edge 112, as illustrated, is in the form of a closed loop.

The dispensing valve 5 is held in the device by gripping between inner walls of the dispensing pipe 8. More precisely, the joining element 11 is gripped by inner walls of the dispensing pipe 8 and between inner walls of the dispensing pipe 8.

It is noted that in the closed state (illustrated in FIG. 1) the outer edge 112 of the cavity is pressed flat against a first inner wall 108 of the dispensing pipe.

It is also noted that in the closed state (illustrated in FIG. 1), a bottom 113 of the pouch 106 (preferably situated opposite the outer edge 112 of the cavity with respect to a centre of the cavity 107) rests against a second inner wall 109 of the dispensing pipe (preferably opposite the first inner wall 108 with respect to the inside of the dispensing pipe 8).

In the open state, the outer edge 112 of the cavity 107 moves away from the first inner wall 108 of the dispensing pipe.

The first inner wall 108 comprises the periphery 116 of the dispensing orifice such that:

- in the closed state, the outer edge 112 (hatched part in FIG. 12) of the cavity 107 is in contact with the entire periphery 116 of the dispensing orifice 105 and surrounds the entire periphery 116 of the dispensing orifice 105 in hermetic manner, without allowing fluid to pass between the reservoir 2 and the dispensing pipe 8,
- in the open state and in the closed state, the bottom 113 of the pouch 106 rests against the second inner wall 109 of the dispensing pipe or of a element situated along the second inner wall 109, and
- in the open state, the outer edge 112 of the cavity moves away from the dispensing orifice 105.

When the dispensing valve 5 is in the open state, the pouch 106 is deformed by a compression (additional with respect to any compression to which the pouch 106 is already subjected when the dispensing valve 5 is in the closed state) perpendicular to dispensing direction 10.

In FIG. 1, It is noted that the device 101 also comprises:

- a main reservoir 17 of the fluid, typically inside an envelope made of flexible plastic film,
- a feed pipe 6, directly connected to the reservoir 17 and arranged in order to guide the fluid originating from the reservoir 17,
- a feed valve 4, which, in an open state, allows fluid to pass from the feed pipe 6 to the inside of the reservoir 2, and, in a closed state, does not allow this.

The feed valve 4 and the dispensing valve 5 are connected by the joining element 11. The two feed 4 and dispensing 5 valves and the joining element 11 are firmly fixed together and in a single piece 12. This single piece 12 is monobloc. The joining element 11 typically has a hardness of 70-80 Shore A.

The feed valve 4 comprises a feed membrane 7. The feed membrane 7 comprises a free end 21 with respect to the joining element 11. This free end 21 is arranged in order to move so as to cause the feed valve 4 to pass between its open and closed states, and is situated in the reservoir 2. The feed membrane 7 also comprises a joining part 22, with the joining element 11. This joining part 22 is situated in the feed pipe 6.

The device 101 also comprises an opening 125. The opening 125 is situated between the dispensing 8 and feed 6 lines. The opening 125 (allowing the feed membrane 7 to pass through during the assembly of the valves 4 and 5 in the device 101 by insertion into the pipe 8) is blocked by the joining element 11.

When the reservoir 2 (more precisely, the cover 15, typically made with a flexible plastic film) is pressed in the pressure direction 3, a positive pressure is created in the reservoir 2, and:

- the feed valve 4 (more precisely its free end 21) is pressed flat against the bottom wall 14 inside the reservoir 2 and is thus held in its closed state, and
- the dispensing valve 5 (more precisely its free end 19) moves away from a wall 108 of the dispensing pipe 8 and is thus held in its open state;

and the fluid contained in the reservoir 2 passes through the dispensing valve 5 in the pressure direction 3 and is expelled from the device 101 via the dispensing pipe 8 in the dispensing direction 10.

When the pressure exerted on the reservoir 2 (more precisely, on the cover 15) in the pressure direction 3 is released, a negative pressure is created in the reservoir 2, and:

- the feed valve 4 (more precisely its free end 21) moves away from the bottom wall 14 inside the reservoir 2 and is thus held in its open state, and
- the dispensing valve 5 (more precisely its free end 19) is pressed flat against an inner wall 108 of the dispensing pipe 8 and is thus held in its closed state, and the liquid contained in the feed pipe 6 passes via the feed orifice 124 through the feed valve 4 parallel to the pressure direction 3 and the reservoir 2 is thus refilled with liquid originating from the main reservoir 17 via the feed pipe 6.

When no pressure is exerted on the reservoir 2 (more precisely, on the cover 15) in the pressure direction 3, the feed valve 4 and the dispensing valve 5 are both held in their closed state.

Thus, the dispensing valve 5 is in the closed state when a pressure variation on the reservoir 2 is negative or zero.

It is noted that the pouch 106 is already slightly compressed when the valve 5 is in its closed state. This makes it possible to ensure good leak-tightness. By contrast, in order to dispense fluid, the force exerted by a user on the cover 15 must be greater than the force exerted by the pouch 106 due to this slight compression.

With reference to FIGS. 3 to 5, a second embodiment 102 of the device according to the invention will now be described, solely for its differences with respect to the first embodiment 101.

In this device 102, in the open state of the dispensing valve 5, the bottom 113 of the pouch 106 moves away from the second inner wall 109 of the dispensing pipe.

The return means 29 comprises the pouch 106 forming the cavity 107, said pouch 106 being situated in the dispensing pipe 8, the pouch 106 being deformed by compression against a wall 108 of the dispensing pipe when the dispensing valve 5 is in the open state.

The second inner wall 109 comprises the periphery 116 of the dispensing orifice 105 such that:

- in the open state and in the closed state, the outer edge 112 of the cavity 107 is in contact with the first inner wall 108 or with an element (for example a stiffening element 119 forming part of the dispensing valve 5 and described below) situated along the first inner wall 108,
- in the closed state, the bottom 113 of the pouch 106 rests against the dispensing orifice 105, and
- in the open state, the bottom 113 of the pouch 106 moves away from the dispensing orifice 105.

Unlike a simple tongue which would create an inhomogeneous return force (stronger on the side of the free end 19 than of the joining part 20), the return means 29 in the form of pouch 106, in the open state (and in the closed state) of the dispensing valve 5, bears on a broad zone of a wall 108 of the dispensing pipe (this broad zone being the zone of contact between the edge 112 and the wall 108), which makes it possible to exert a more homogeneous return force over the entire periphery 116 of the dispensing orifice 105.

With reference to FIGS. 6 to 9, a third embodiment 103 of the device according to the invention will now be described, solely for its differences with respect to the second embodiment 102.

In this embodiment, the dispensing valve 5 is offset with respect to the dispensing orifice 105.

The second inner wall 109 is provided with a convex boss 114 (extending longitudinally in the dispensing direction 10) and the bottom 113 of the pouch 106 is provided with a concave recess 115 (extending longitudinally in the dispensing direction 10) of a shape complementary to the convex boss 114 such that in the closed state, the concave recess fits the shape of the convex boss.

In the open state, the bottom 113 of the pouch 106 moves away from the second inner wall 109 of the dispensing pipe, and the concave recess 115 makes it possible to guide the fluid out of the device 103 in centred manner.

It is noted that this boss 114 and this recess 115 can be combined with any other embodiment of the invention described (in the case of the device 101, the first inner wall 108 will be provided with the convex boss 114 and the edge 112 of the cavity will be provided with the concave recess 115; in the case of the device 104, the first inner wall 110 will be provided with the convex boss 114 and the first side 117 of the loop will be provided with the concave recess 115).

With reference to FIG. 9, the edge 112 is equipped with a seal in contact with the inner wall 108. The benefit of this seal is to completely close the pouch 106 in hermetic manner, without any passage of fluid or any hole between the cavity 107 and the outside of the pouch 106. This is particularly advantageous as this limits the variations in the stiffness of the "spring" formed by the pouch 106 as a function of the temperature. In fact, when the temperature increases, the stiffness of a plastic or of an elastomer of the pouch 106 will decrease (leading to a decrease in the stiffness of the "spring" formed by the pouch 106), but the air or the gas enclosed in the cavity 107 of the pouch 106 will expand and the pressure in the pouch 106 will increase (leading to an increase in the stiffness of the "spring" formed by the pouch 106), the two phenomena partially offsetting each other.

The pouch 106 is firmly fixed to a stiffening element 119 stiffer than any part of the pouch 106 and extending (preferably over the entire length (defined in the dispensing direction 10) of the pouch 106) in the dispensing direction 10. This stiffening element 119 can be combined with any other embodiment of dispensing valve 5 or of device 101, 102, 103, 104 of the invention described, and makes it possible to facilitate the insertion of the dispensing valve 5 inside the dispensing pipe 8 during its assembly in a device according to the invention.

With reference to FIGS. 10 and 11, a fourth embodiment 104 of device according to the invention will now be described solely for its differences with respect to the first embodiment 101.

In the dispensing valve 5, the pouch 106 forms in a plane (the plane of FIG. 11, parallel to the direction of dispensing 10 and elongation of the pipe 8) a closed loop inside which the cavity 107 is delimited such that:

- in the closed state a first side 117 of the loop is pressed flat against a first inner wall 110 of the dispensing pipe,
- in the open state and in the closed state, a second side 118 of the loop (preferably situated opposite the first side of the loop with respect to the centre of the cavity 107) rests against a second inner wall 111 of the dispensing pipe (preferably opposite the first inner wall with respect to the inside of the dispensing pipe 8) or of an element (for example a stiffening element 119 forming part of the dispensing valve 5 and described previously) situated along the second inner wall 111, and
- in the open state, the first side 117 of the loop moves away from the first inner wall 110 of the dispensing pipe.

The first inner wall 110 comprises the periphery 116 of the dispensing orifice 105 such that:

- in the closed state the first side of the loop 117 is pressed flat against the dispensing orifice 105 in hermetic manner without allowing fluid to pass between the reservoir 2 and the dispensing pipe,
- in the open state, the first side of the loop 117 moves away from the dispensing orifice 105 in order to allow fluid to pass between the reservoir 2 and the dispensing pipe.

It is noted that the device 104 comprises no feed valve 4.

The dispensing valve 5 can be equipped with a hole making it possible for a tool to be passed through the dispensing pipe 8 and for this tool to be passed between the valve 5 and an inner wall of the dispensing pipe 8 (in order to push the joining element 11) in order to facilitate the introduction of the valve 5 into the pipe 8.

When the reservoir 2 is pressed on (as for a tube of toothpaste), a positive pressure is created in the reservoir 2, and the dispensing valve 5 moves away from the dispensing orifice 105.

The pouch 106 of the device 104 can be:

- either open, for example in front of and behind the plane of FIG. 11
- or the pouch 106 is a completely closed pouch completely with no passage of fluid or any hole between the cavity 107 and the outside of the pouch 106. This is particularly advantageous as it limits the variations in stiffness of the "spring" formed by the pouch 106 as a function of the temperature. In fact, when the temperature increases, the stiffness of a plastic or of an elastomer of the pouch 106 will decrease (leading to a decrease in the stiffness of the "spring" formed by the pouch 106), but the air or the gas enclosed in the cavity 107 of the pouch 106 will expand and the pressure in the pouch 106 will increase (leading to an increase in the stiffness of the "spring" formed by the pouch 106), the two phenomena partially offsetting each other.

It can be seen that, in variants, the pouch 106 of the dispensing valve 5 of each device 101, 102, 103 could be completely closed, i.e. without an opening delimited by the edge 112.

Moreover, as for the third embodiment 103, the dispensing valve 5 of the device 104 could, in a variant, be offset with respect to the dispensing orifice 105.

It is noted that the dispensing valve 5 of the device 104 can also be adapted in order to be firmly fixed to a feed valve 4 as previously described with reference to the previous embodiments.

Generally, each dispensing valve 5 of the different embodiments of device 101, 102, 103, 104 can comprise, in its cavity 107, a folded blade 123 which will confer an additional spring effect. This folded blade 123 is preferably metallic. This folded blade 123 is preferably folded in a U shape.

Generally, each dispensing valve 5 of the different embodiments of device 101, 102, 103, 104 can be arranged in the device so as to be flush with the outlet of the dispensing pipe 8 to the outside of the device according to the invention, as shown in FIGS. 6 and 11. In this way, zones comprising fluid which dries between two fluid dispensing operations are avoided.

It is noted that in all the figures of the previously described embodiments, the directions 3 and 120 are merged.

It is noted that in all the figures of the previously described embodiments, the dispensing valve is, in its closed state, held pressed flat against a part (called the dispensing seat) of an inner wall of the dispensing pipe 8. More precisely, the dispensing valve comprises a membrane 9 or 117 (preferably flat) which, in the closed state of the dispensing valve, is held pressed flat against a part (called the dispensing seat) of an inner wall of the dispensing pipe 8. It is also noted that the dispensing seat is a side part of the dispensing pipe 8, i.e. this seat is limited to one, preferably flat, face of the dispensing pipe 8, and does not go all the way round a cross section of the dispensing pipe 8 which would be realized in a plane perpendicular to the direction of dispensing 10 or elongation of the pipe 8.

It is noted that in all the figures of the previously described embodiments, the dispensing valve is, in its open state, deformed by compression (and not by traction) perpendicular to the direction of dispensing 10 and elongation of the pipe 8 with respect to its closed state, so as to press the dispensing valve flat against a side wall of the pipe 8.

It is noted that in the previously described embodiments in FIGS. 1 to 9, the dispensing valve (more precisely the membrane 9) is, in its open state, deformed by compression (and not by traction) parallel to the direction 3 with respect to its closed state.

Preferably, in all the figures of the previously described embodiments, the ratio between:

the thickness of the cavity of the pouch (maximum dimension of the cavity measured inside the cavity, under the membrane 9 or 117, and vertically in the planes of FIGS. 1, 3, 6, 7 and 11, i.e. perpendicular to the direction of dispensing 10 and elongation of the pipe 8 and parallel to the direction 120), typically comprised between 0.2 and 1.2 mm and the width of the pouch (maximum dimension of the pouch measured outside the cavity and measured perpendicular to the planes of FIGS. 1, 3, 6, and 11 i.e. perpendicular to the direction of dispensing 10 and elongation of the pipe 8 and perpendicular to the direction 120)

is less than or equal to 2, preferably less than or equal to 1.

It is noted that in the previously described embodiments, the pouch is thin and flexible. Thus, the pouch is arranged in order, in the open state of the dispensing valve, not to open completely. The pouch is there in order to press flat a flexible membrane (typically 9 or 117):

either against an orifice 105 connecting (directly or with intermediates) the reservoir to the dispensing pipe 8 (case of FIGS. 1 to 5 and 10 to 12), or against a part of the dispensing channel 8 (case of FIGS. 6 to 9)

In the case of FIGS. 6 to 11, the pouch (more precisely the membrane 9 or 117) is pressed flat against an upper wall of the dispensing pipe 8 along two lines extending in the direction of dispensing 10 and elongation of the pipe 8, such that when the membrane 9 or 117 opens (in the open state of the dispensing valve), the membrane 9 or 117 opens between these two bearing lines, adopting a convex shape but keeping these two bearing lines of the membrane 9 or 117 against the upper wall of the dispensing pipe 8.

In the case of FIGS. 6 to 9, a part 119 of the dispensing valve is assembled gripped in the pipe 8 allowing a leak-tightness, and the gripping decreases up to the centre of the membrane 9. At rest, the membrane 9 is always in contact with the pipe 8 in order to allow good leak-tightness. When the membrane 9 opens (i.e. in the open state of the dispensing valve) there is only partial detachment of the membrane 9 with respect to its seat.

Preferably the membranes 9, 117 have a hardness of the order of 70-85 SHORE A, preferably less than 95 SHORE A.

A slight pressure from the user allows a small deformation of the pouch/membrane and thus precise control of the outlet of product; it is possible to dispense one drop thereof or less.

Of course, the invention is not limited to the examples which have just been described and numerous adjustments can be made to these examples without exceeding the scope of the invention.

In variants of each of the previously described embodiments, the membrane 9 can be reduced only at the bottom 113 or at the edge 112 which can be very thin.

In variants of each of the previously described embodiments, the cross section of the dispensing pipe 8 is not necessarily rectangular.

For example, in variants of each of the previously described embodiments the feed 4 and dispensing 5 valves can be spaced out and not firmly fixed together without exceeding the scope of the invention. The dispensing valve 5 can be firmly fixed to the joining element 11 as previously described, without this joining element 11 necessarily being firmly fixed to the feed valve 4. The feed valve 4 can then be fixed by any other means, for example fixed by means of clips.

Moreover, in variants of each of the previously described embodiments, the feed valve 4 can also be omitted.

Moreover, in variants of each of the previously described embodiments, the device according to the invention can comprise several dispensing and/or feed valves (for example for dispensing several fluids).

Of course, the different characteristics, shapes, variants and embodiments of the invention can be combined with each other.

The invention claimed is:

1. A device for dispensing a fluid, comprising:
a reservoir arranged in order to contain the fluid,
a dispensing pipe arranged in order to guide the fluid in a dispensing direction,
a dispensing orifice connecting the reservoir to the dispensing pipe,
a dispensing valve which, in an open state, allows fluid to pass from the inside of the reservoir to the dispensing pipe via the dispensing orifice, and, in a closed state, does not allow fluid to pass from the inside of the reservoir to the dispensing pipe, and
a return means arranged in order to exert a force on the dispensing valve, this force bringing the dispensing valve back from its open state to its closed state,
wherein the return means comprises a pouch forming a cavity, said pouch being situated in the dispensing pipe, the pouch being deformed by compression when the dispensing valve is in the open state, wherein the pouch is a pouch that is open on one side by an opening delimited by an outer edge of the cavity such that:
in the closed state the outer edge of the cavity is pressed flat against a first inner wall of the dispensing pipe, and
in the closed state, the pouch is subjected to compression against a second inner wall of the dispensing pipe, and
wherein in the open state, the outer edge of the cavity of the pouch moves away from the first inner wall of the dispensing pipe.

2. A device for dispensing a fluid, comprising:
a reservoir arranged in order to contain the fluid,
a dispensing pipe arranged in order to guide the fluid in a dispensing direction,
a dispensing orifice connecting the reservoir to the dispensing pipe,
a dispensing valve which, in an open state, allows fluid to pass from the inside of the reservoir to the dispensing pipe via the dispensing orifice, and, in a closed state, does not allow fluid to pass from the inside of the reservoir to the dispensing pipe, and
a return means arranged in order to exert a force on the dispensing valve, this force bringing the dispensing valve back from its open state to its closed state,
wherein the return means comprises a pouch forming a cavity, said pouch being situated in the dispensing pipe, the pouch being deformed by compression, due to a fluid pressure within the reservoir, when the dispensing valve is in the open state, wherein the pouch is a pouch that is open on one side by an opening delimited by an outer edge of the cavity such that:
in the closed state the pouch is subjected to compression against a first inner wall of the dispensing pipe, and
in the closed state, a bottom of the pouch is pressed flat against a second inner wall of the dispensing pipe, and
wherein in the open state, the bottom of the pouch moves away from the second inner wall of the dispensing pipe.

3. The device according to claim 1, wherein the first inner wall comprises a periphery of the dispensing orifice such that:
in the closed state the outer edge of the cavity is in contact with a part of, or the entire periphery of the dispensing orifice or surrounds a part of or the entire periphery of the dispensing orifice,
in the open state and in the closed state, the pouch is subjected to compression against the second inner wall of the dispensing pipe, and
in the open state, the outer edge of the cavity moves away from the dispensing orifice.

4. A device for dispensing a fluid, comprising:
a reservoir arranged in order to contain the fluid,
a dispensing pipe arranged in order to guide the fluid in a dispensing direction,
a dispensing orifice connecting the reservoir to the dispensing pipe,
a dispensing valve which, in an open state, allows fluid to pass from the inside of the reservoir to the dispensing pipe via the dispensing orifice, and, in a closed state, does not allow fluid to pass from the inside of the reservoir to the dispensing pipe, and
a return means arranged in order to exert a force on the dispensing valve, this force bringing the dispensing valve back from its open state to its closed state,
wherein the return means comprises a pouch forming a cavity, said pouch being situated in the dispensing pipe, the pouch being deformed by compression when the dispensing valve is in the open state,
wherein the dispensing valve comprises a dispensing membrane, the pouch forming, in a plane, a closed loop inside which the cavity is delimited such that:
in the closed state the dispensing membrane or a first side of the loop is pressed flat against a first inner wall of the dispensing pipe,
in the open state and in the closed state, the pouch is subjected to compression against a second inner wall of the dispensing pipe, and
in the open state, the first side of the loop moves away from the first inner wall of the dispensing pipe.

5. The device according to claim 4, wherein the first inner wall comprises a periphery of the dispensing orifice such that:
in the closed state the dispensing membrane or the first side of the loop is pressed flat against the dispensing orifice without allowing fluid to pass between the reservoir and the dispensing pipe,
in the open state, the first side of the loop moves away from the dispensing orifice in order to allow fluid to pass between the reservoir and the dispensing pipe.

6. The device according to claim 1, wherein the dispensing valve is formed as one piece that comprises the pouch and a stiffening element that is stiffer than the pouch and extends in the dispensing direction.

7. The device according to claim 1, wherein the first inner wall and the second inner wall face one another and are each disposed downstream of the dispensing orifice, and wherein the first inner wall and the second inner wall delimit a dispensing passage formed by the dispensing pipe downstream of the entire dispensing orifice.

8. The device according to claim 7, wherein the outer edge of the cavity faces perpendicular to the first inner wall, the bottom of the pouch faces perpendicular to the second inner wall, and
wherein when the dispensing valve is in the open state, the outer edge of the cavity moves perpendicularly away from the first inner wall or the bottom of the pouch moves perpendicularly away from the second inner wall.

9. The device according to claim 4, wherein the first inner wall and the second inner wall face one another and are each disposed downstream of the dispensing orifice, and wherein the first inner wall and the second inner wall delimit a dispensing passage formed by the dispensing pipe downstream of the entire dispensing orifice.

10. The device according to claim 1, wherein in the closed state, the pouch is open in a single plane by the opening delimited by the outer edge of the cavity, and the outer edge is in contact with and surrounds an entire periphery of the dispensing orifice.

11. The device according to claim 4, wherein the first inner wall includes a periphery of the dispensing orifice, the periphery is a planar surface that faces toward the first side of the loop, and in the closed state a planar portion of the first side contacts the entire periphery.

12. The device according to claim 2, wherein in the open state, the bottom of the pouch moves away from the second inner wall of the dispensing pipe, the second inner wall being provided with a convex boss and the bottom of the pouch being provided with a concave recess of a shape complementary to the convex boss such that in the closed state, the concave recess fits the shape of the convex boss.

13. The device according to claim 2, wherein in the open state the bottom of the pouch moves away from the second inner wall of the dispensing pipe.

14. The device according to claim 2, wherein the pouch comprises a dispensing membrane in order to close the dispensing orifice.

15. The device according to claim 2, wherein the second inner wall comprises a periphery of the dispensing orifice such that:

in the open state and in the closed state, the outer edge of the cavity is in contact with the first inner wall in the closed state, the bottom of the pouch rests against the dispensing orifice, and in the open state, the bottom of the pouch moves away from the dispensing orifice.

16. The device according to claim 15, wherein the bottom of the pouch and the remainder of the pouch are made of two different materials, the bottom of the pouch being made of a stiffer material than the remainder of the pouch.

17. The device according to claim 16, wherein the first inner wall comprises a periphery of the dispensing orifice such that:

in the closed state the dispensing membrane or a first side of the loop is pressed flat against the dispensing orifice without allowing fluid to pass between the reservoir and the dispensing pipe, in the open state, the first side of the loop moves away from the dispensing orifice in order to allow fluid to pass between the reservoir and the dispensing pipe.

18. A device for dispensing a fluid, comprising:

a reservoir arranged in order to contain the fluid, a dispensing pipe arranged in order to guide the fluid in a dispensing direction, a dispensing orifice connecting the reservoir to the dispensing pipe, a dispensing valve which, in an open state, allows fluid to pass from the inside of the reservoir to the dispensing pipe via the dispensing orifice, and, in a closed state, does not allow fluid to pass from the inside of the reservoir to the dispensing pipe, and a return means arranged in order to exert a force on the dispensing valve, this force bringing the dispensing valve back from its open state to its closed state, wherein the return means comprises a pouch forming a cavity, said pouch being situated in the dispensing pipe, the pouch being deformed by compression when the dispensing valve is in the open state, wherein the pouch forms, in a plane, a closed loop inside which the cavity is delimited such that:

in the closed state the dispensing membrane or a first side of the loop is pressed flat against a first inner wall of the dispensing pipe, in the open state and in the closed state, a second side of the loop rests against a second inner wall of the dispensing pipe, and in the open state, the first side of the loop moves away from the first inner wall of the dispensing pipe.

19. The device according to claim 1, wherein the pouch comprises a dispensing membrane in order to close the dispensing orifice.

20. The device according to claim 4, wherein the plane extends along the dispensing direction and a portion of an outer periphery of the closed loop expands radially outwardly when in the open state.

* * * * *